US009752345B1

(12) United States Patent
LaHood

(10) Patent No.: US 9,752,345 B1
(45) Date of Patent: Sep. 5, 2017

(54) CONVERTIBLE SHELTER SYSTEMS

(71) Applicant: CLAM CORPORATION, Rogers, MN (US)

(72) Inventor: John Matthew LaHood, Waconia, MN (US)

(73) Assignee: Clam Corporation, Rogers, MN (US)

( * ) Notice: Subject to any disclaimer, the term of this patent is extended or adjusted under 35 U.S.C. 154(b) by 0 days.

(21) Appl. No.: 15/042,801

(22) Filed: Feb. 12, 2016

(51) Int. Cl.
*E04H 15/18* (2006.01)
*E04H 15/58* (2006.01)
*E04H 15/64* (2006.01)

(52) U.S. Cl.
CPC ..... *E04H 15/18* (2013.01); *E04H 15/58* (2013.01); *E04H 15/64* (2013.01)

(58) Field of Classification Search
CPC ..... E04H 15/18
USPC ..... 135/97
See application file for complete search history.

(56) References Cited

U.S. PATENT DOCUMENTS 1,728,356 A 9/1929 Morgan
3,368,575 A 2/1968 Besonen
3,550,601 A 12/1970 Peters
3,699,986 A * 10/1972 Kirkham ..... E04H 15/30 135/116
3,709,237 A 1/1973 Smith
3,810,482 A 5/1974 Beavers
3,847,170 A 11/1974 Anderson
3,941,140 A 3/1976 Beavers
3,958,289 A 5/1976 Carlson
3,965,915 A * 6/1976 Kirkham ..... E04H 15/18 135/117
4,026,312 A 5/1977 Beavers
4,063,566 A * 12/1977 Millerioux ..... E04H 15/18 135/116
4,067,346 A 1/1978 Husted
4,077,417 A 3/1978 Beavers
4,239,247 A 12/1980 Hinz
4,285,355 A * 8/1981 Lundblade ..... E04H 15/42 135/147
4,526,391 A 7/1985 Winkelman et al.
4,632,138 A 12/1986 Irwin
4,730,569 A 3/1988 Colson
4,819,680 A 4/1989 Beavers
4,858,635 A * 8/1989 Eppenbach ..... E04H 15/425 135/117
4,917,217 A 4/1990 Marble et al.
4,941,499 A 7/1990 Pelsue et al.
D313,061 S 12/1990 Bascom et al.
4,979,532 A 12/1990 Johansson et al.
5,050,526 A 9/1991 Nelson et al.
5,159,948 A * 11/1992 Moreau ..... E04H 15/42 135/125
5,222,513 A 6/1993 Hilliard
(Continued)

*Primary Examiner* — Noah Chandler Hawk
(74) *Attorney, Agent, or Firm* — Cook Alex Ltd.

(57) ABSTRACT

A convertible shelter system includes an enclosure having a removable side wall that selectively may be hinged to provide open access or to be held in an open position as a wind break. The convertible shelter system also includes the ability to fully remove the removable side wall on two enclosures having the same construction and to quickly and conveniently connect the remaining enclosure structures with a bridging panel, resulting in an enlarged, combined space while maintaining an essentially unobstructed ground surface.

11 Claims, 8 Drawing Sheets

(56) References Cited

U.S. PATENT DOCUMENTS

| | | | | |
|---|---|---|---|---|
| D339,842 | S | 9/1993 | Spiczka | |
| 5,251,921 | A | 10/1993 | Daniels | |
| 5,382,111 | A | 1/1995 | Melashenko et al. | |
| 5,394,897 | A | 3/1995 | Ritchey et al. | |
| 5,402,596 | A | 4/1995 | Gillming, Jr. | |
| 5,575,490 | A | 11/1996 | Simpson, Jr. | |
| 5,592,961 | A | 1/1997 | Chin | |
| 5,593,061 | A | 1/1997 | Prochnow | |
| 5,620,396 | A | 4/1997 | Westphal | |
| 5,628,338 | A | 5/1997 | Stumbo | |
| 5,820,189 | A | 10/1998 | Tew | |
| 5,906,217 | A | 5/1999 | Hill | |
| 6,014,833 | A | 1/2000 | Benavidez | |
| 6,098,335 | A | 8/2000 | Brown, Jr. | |
| 6,145,525 | A | 11/2000 | Mooney | |
| 6,192,633 | B1 | 2/2001 | Hilbert | |
| 6,360,761 | B1 | 3/2002 | Zheng | |
| 6,565,139 | B2 * | 5/2003 | Bayerle | B60J 11/00 135/127 |
| 6,701,948 | B2 | 3/2004 | Jopp et al. | |
| 6,782,905 | B2 | 8/2004 | Chu et al. | |
| 6,854,476 | B1 | 2/2005 | Chai | |
| 7,040,335 | B1 | 5/2006 | Ransom | |
| 7,185,666 | B2 | 3/2007 | Chai | |
| 7,614,415 | B1 * | 11/2009 | Wehner | A01G 9/16 135/126 |
| 7,743,781 | B2 | 6/2010 | Slaughter | |
| 7,958,904 | B2 | 6/2011 | Lau | |
| 8,915,258 | B1 | 12/2014 | Beam et al. | |
| 9,085,914 | B1 | 7/2015 | Kulm | |
| 9,103,137 | B2 * | 8/2015 | Williams | E04H 15/18 |
| 9,163,425 | B1 | 10/2015 | Kubica et al. | |
| 9,238,924 | B2 * | 1/2016 | Wyant | E04H 15/001 |
| 9,470,010 | B2 * | 10/2016 | Youn | E04H 15/64 |
| 2002/0134415 | A1 * | 9/2002 | Boulange | E04H 15/18 135/117 |
| 2004/0238021 | A1 * | 12/2004 | Holub | E04H 15/18 135/97 |
| 2005/0100400 | A1 | 5/2005 | Fulcher et al. | |
| 2005/0189009 | A1 * | 9/2005 | Walter | E04H 15/32 135/97 |
| 2006/0060235 | A1 | 3/2006 | Ball | |
| 2008/0083443 | A1 | 4/2008 | Eastman | |
| 2008/0210283 | A1 | 9/2008 | Hinz et al. | |
| 2009/0084420 | A1 | 4/2009 | Pelsue | |
| 2010/0200038 | A1 | 8/2010 | Roman et al. | |
| 2011/0168221 | A1 | 7/2011 | Schlipf | |
| 2013/0074894 | A1 | 3/2013 | Cook | |
| 2013/0306121 | A1 | 11/2013 | Hung Lau | |

* cited by examiner

CONVERTIBLE SHELTER SYSTEMS

BACKGROUND OF THE INVENTION

Field of the Invention

The present invention generally relates to portable shelters, and more particularly to convertible shelter systems and methods that permit hinging of a side wall or removal of a side wall and connection of two similarly constructed enclosures using a bridging panel to achieve one elongated enclosure defining an open floor space.

Discussion of the Prior Art

Portable shelters, such as may be used for ice fishing, are known and typically include a lightweight flexible enclosure supported by a collapsible frame. The flexible enclosure often has multiple side walls, with each side wall permanently connected to adjacent side walls and to a top wall. When the collapsible frame is erected, the enclosure is free standing. Such portable shelters generally are sized to accommodate one or two individuals and their gear with the exposed ground surface serving as a floor.

SUMMARY OF THE INVENTION

The purpose and advantages of the invention will be set forth in and apparent from the description and drawings that follow, as well as will be learned by practice of the claimed subject matter.

This disclosure generally provides convertible shelter systems that retain the qualities of compactness, light weight and easy set-up of portable shelters, yet have desirable advantages. The convertible shelter systems feature an enclosure having a removable side wall that selectively may be hinged to provide enhanced, quick and open access for ease in moving items into or out of the enclosure. The hinged side wall also can be held in an open position, such as by staking to a ground surface, to serve as a wind break, if desired. The convertible shelter systems also feature the ability to fully remove the removable side wall on two enclosures having the same construction, and to quickly and conveniently connect the remaining enclosure structures with a bridging panel, without requiring the use of tools. The connected enclosures and bridging panel advantageously provide an enlarged, combined space having greater capacity, while maintaining an essentially unobstructed ground surface. The enhanced interior space is capable of accommodating more occupants, furnishings and gear. The open floor space and absence of one or more intermediate interior walls also facilitate more flexible arrangements for furnishings and other items, as well as greater freedom of movement throughout the interior for the occupants.

In a first aspect, this disclosure provides a convertible shelter system having an enclosure that includes a plurality of interconnected side walls defining an open floor space and being connected to a top wall, with at least one of the side walls being removable, wherein the removable side wall has opposed first and second side edges and a top edge and defines an opening in the enclosure. The opening in the enclosure has a perimeter edge that further comprises a connecting member that is configured to selectively disconnect the removable side wall from the perimeter edge of the opening along the first and second side edges and the top edge of the removable side wall or to hinge the removable side wall from the enclosure by disconnecting the removable side wall from the perimeter edge of the opening along the first side edge and the top edge of the removable side wall.

In another aspect, this disclosure provides a convertible shelter system having an enclosure that includes a plurality of interconnected side walls defining an open floor space and being connected to a top wall, with at least one of the side walls being removable, wherein the removable side wall has opposed first and second side edges and a top edge and defines an opening in the enclosure. The opening in the enclosure has a perimeter edge that further comprises a connecting member that is configured to selectively disconnect the removable side wall from the perimeter edge of the opening along the first and second side edges and the top edge of the removable side wall or to hinge the removable side wall from the enclosure by disconnecting the removable side wall from the perimeter edge of the opening along the first side edge and the top edge of the removable side wall. The convertible shelter system further has a second enclosure that includes a plurality of interconnected side walls defining an open floor space and being connected to a top wall, with at least one of the side walls being removable, wherein the removable side wall has opposed first and second side edges and a top edge and defines an opening in the second enclosure. The opening in the second enclosure has a perimeter edge that further comprises a connecting member that is configured to selectively disconnect the removable side wall from the perimeter edge of the opening along the first and second side edges and the top edge of the removable side wall or to hinge the removable side wall from the second enclosure by disconnecting the removable side wall from the perimeter edge of the opening along the first side edge and the top edge of the removable side wall. The convertible shelter system additionally includes a bridging panel having first and second opposed side edges with the first opposed side edge configured to be connected to the first enclosure at the opening of the first enclosure and the second opposed side edge configured to be connected to the second enclosure at the opening of the second enclosure, and wherein when the at least one removable side wall is removed from each of the first and second enclosures and the respective openings are located in an opposed and spaced apart position and the first enclosure is connected by the bridging panel to the second enclosure, the interconnected bridging panel and side walls of the first and second enclosures define an open and continuous floor space.

In a further aspect, this disclosure provides a method of assembling a convertible shelter system that includes the steps of providing a first enclosure, a second enclosure and a bridging panel, wherein each of the first and second enclosures includes a plurality of interconnected side walls defining an open floor space and being connected to a top wall, with the first and second enclosures each having at least one of the side walls being removable, wherein the removable side wall has opposed first and second side edges and a top edge and defines an opening in the respective enclosure, wherein the opening in the respective enclosure has a perimeter edge, and wherein the bridging panel has first and second opposed side edges with the first and second opposed side edges with the first opposed side edge configured to be connected to the first enclosure at the opening of the first enclosure and the second opposed side edge configured to be connected to the second enclosure at the opening of the second enclosure. The method further includes the steps of removing the removable side wall of the first enclosure, removing the removable side wall of the second enclosure, positioning the first and second enclosures to have the opening defined by the removed removable side wall of the first enclosure opposed to and spaced from the opening defined by the removed removable side wall of the second enclosure, and connecting the first enclosure at the opening defined by the removed removable side wall of the first enclosure to the first opposed side edge of the bridging panel and connecting the second enclosure at the opening defined by the removed removable side wall of the second enclosure to the second opposed side edge of the bridging panel, wherein the interconnected bridging panel and side walls of the first and second enclosures define an open and continuous floor space.

As above noted, the example convertible shelter systems and example methods of assembling convertible shelter systems of this disclosure provide several advantageous features. The example systems and methods provide the ability to quickly and conveniently hinge a side wall of an enclosure, or to remove a side wall from an enclosure, and to combine similar portable first and second enclosures, each having a side wall removed. This is accomplished by being able to readily remove a side wall from each of the first and second enclosures, thereby defining an opening in each of the first and second enclosures. The first and second enclosures then are positioned to have the respective openings be opposed to and spaced apart from each other. The bridging panel then may be conveniently used to connect the first and second enclosures. The resulting assembled convertible shelter system has at least twice the floor space of one of the first and second enclosures, with the floor space being open and essentially unobstructed. Thus, occupants need not step or crawl through a tube when passing from one enclosure to another. Rather, the open floor space of the present convertible shelter system permits advantageous flexibility as to where furnishings and gear may be placed and allows occupants to move more freely within the interior of the convertible shelter system. The examples also offer the ability to accomplish these advantages with the further convenience of each of the enclosures having a pop up structure. This permits each of the enclosures and the entire convertible shelter system to be swiftly erected and/or collapsed, without the use of tools.

It is to be understood that both the foregoing general description and the following detailed description are exemplary and provided for purposes of explanation only, and are not restrictive of the subject matter claimed. Further features and objects of the present disclosure will become more fully apparent in the following description of the preferred embodiments and from the appended claims.

BRIEF DESCRIPTION OF THE DRAWINGS

In describing the preferred embodiments, reference is made to the accompanying drawing figures wherein like parts have like reference numerals, and wherein.

It should be understood that the drawings are not to scale. While some mechanical details of example convertible shelter systems, including other plan and section views of the examples shown and of examples that may have alternative configurations, have not been included, such details are considered well within the comprehension of those of skill in the art in light of the present disclosure. It also should be understood that the present invention is not limited to the example embodiments illustrated.

DETAILED DESCRIPTION OF THE PREFERRED EMBODIMENTS

For the following defined terms, these definitions shall be applied, unless a different definition is given in the claims or elsewhere in this disclosure. As used in this disclosure and the appended claims, the singular forms "a", "an", and "the" include plural referents unless the content clearly dictates otherwise. As used in this disclosure and the appended claims, the term "or" is generally employed in its sense including "and/or" unless the content clearly dictates otherwise.

Referring generally to FIGS. 1-9, it will be appreciated that convertible shelter systems of the present disclosure generally may be embodied within numerous configurations, and may be used in various ways to alter and enhance the convenience of users. Indeed, while acknowledging that all of the example configurations of convertible shelter systems need not be shown herein, examples are provided to better demonstrate that a variety of configurations and methods of use are contemplated.

Figure 1:
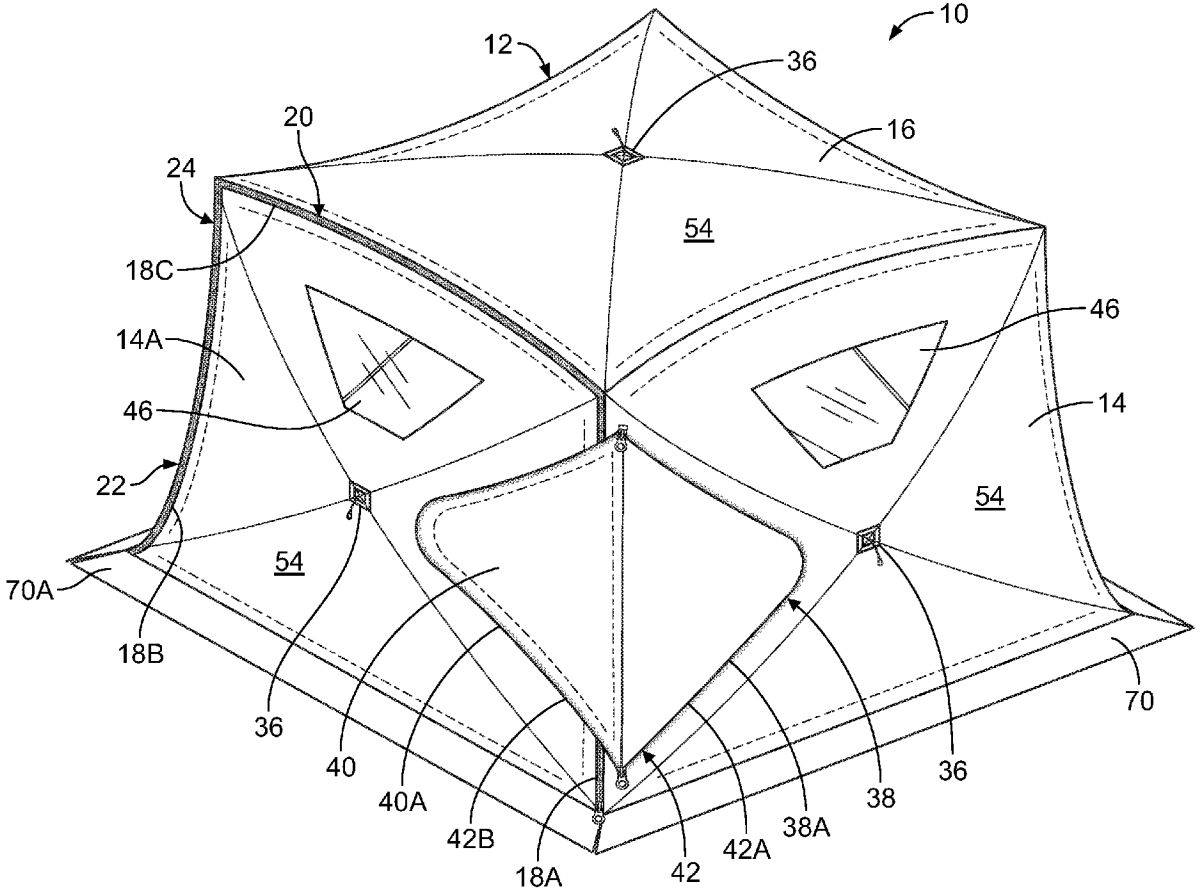
FIG. 1 is a perspective view of an example convertible shelter system of the present disclosure including an enclosure having a removable side wall.
Figure 2:
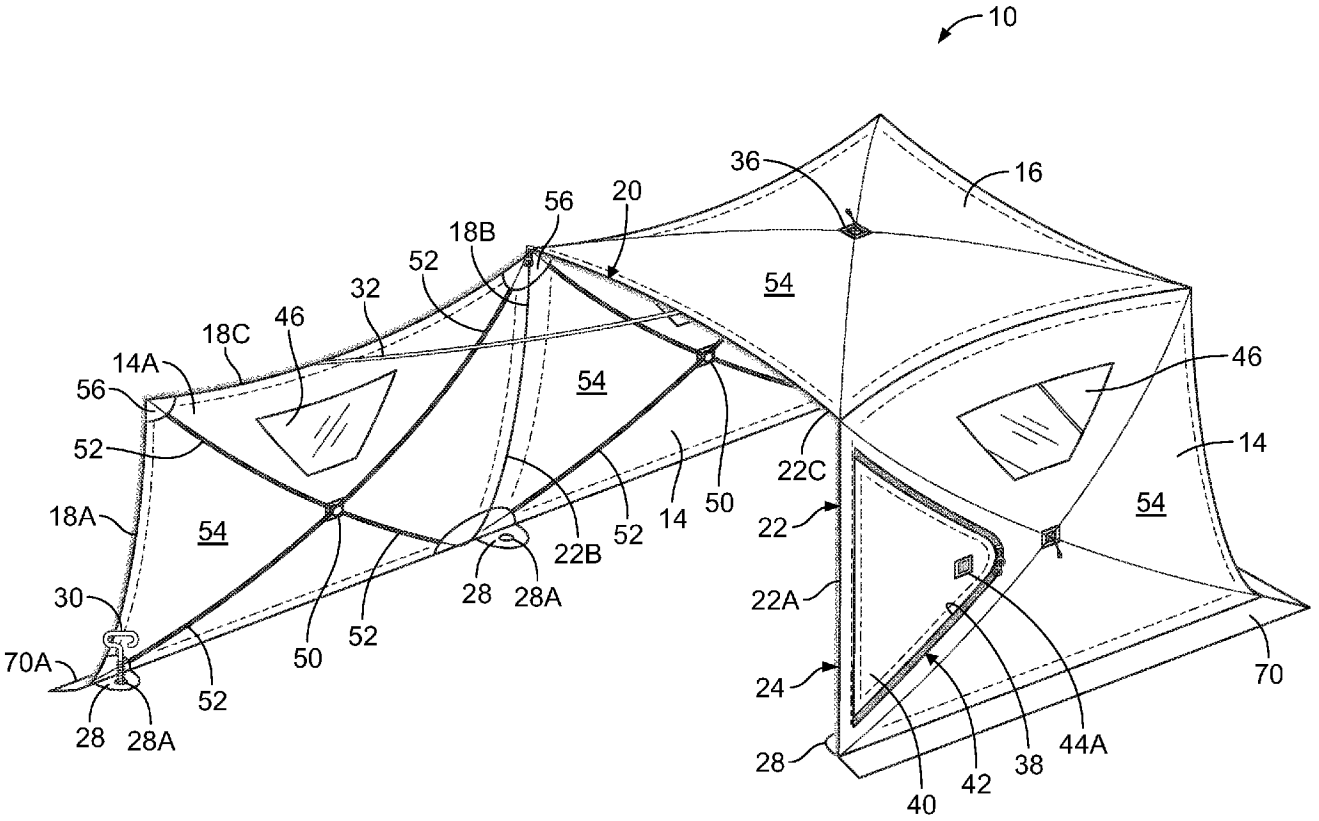
FIG. 2 is a perspective view of the example convertible shelter system of FIG. 1, showing the removable side wall hinged to an open position and showing the interior side of the hinged side wall.
Figure 3:
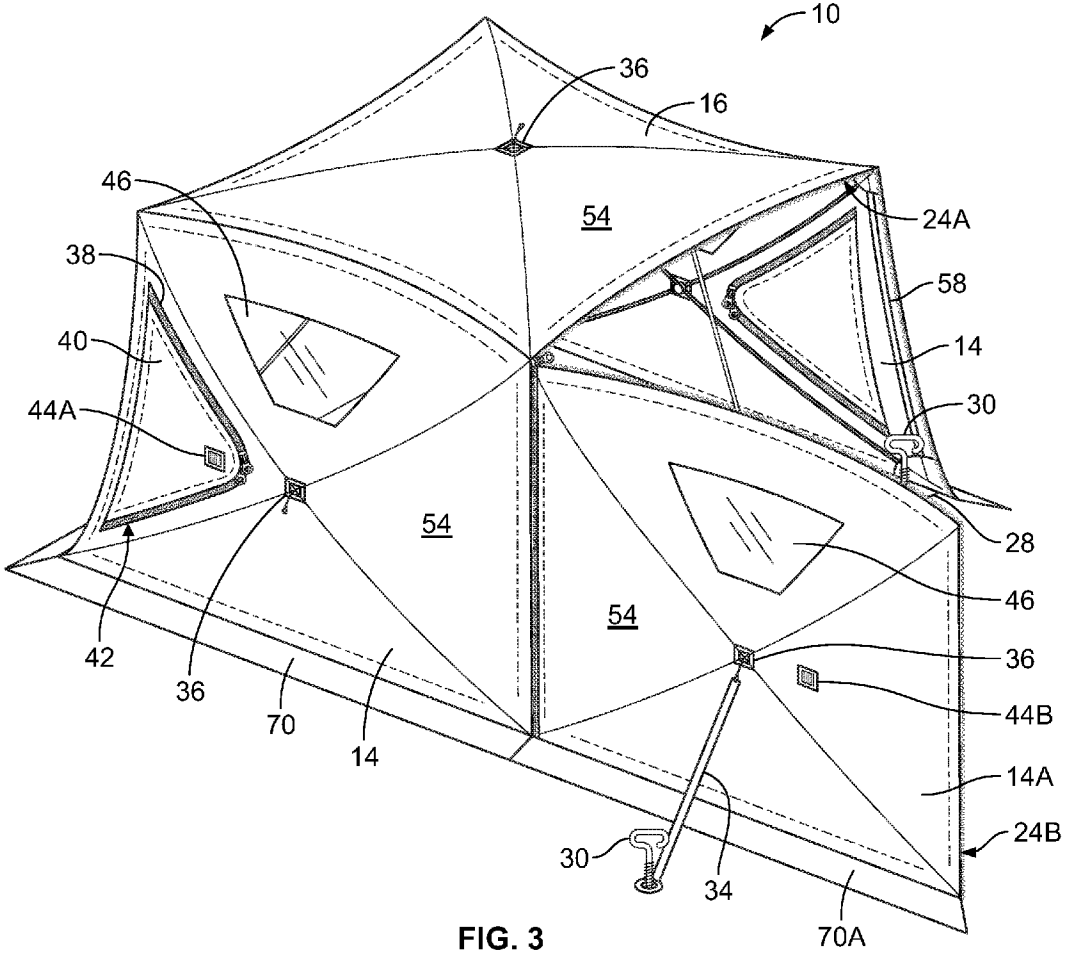
FIG. 3 is a perspective view of the example convertible shelter system of FIG. 2, showing the exterior side of the hinged side wall.
Figure 4:
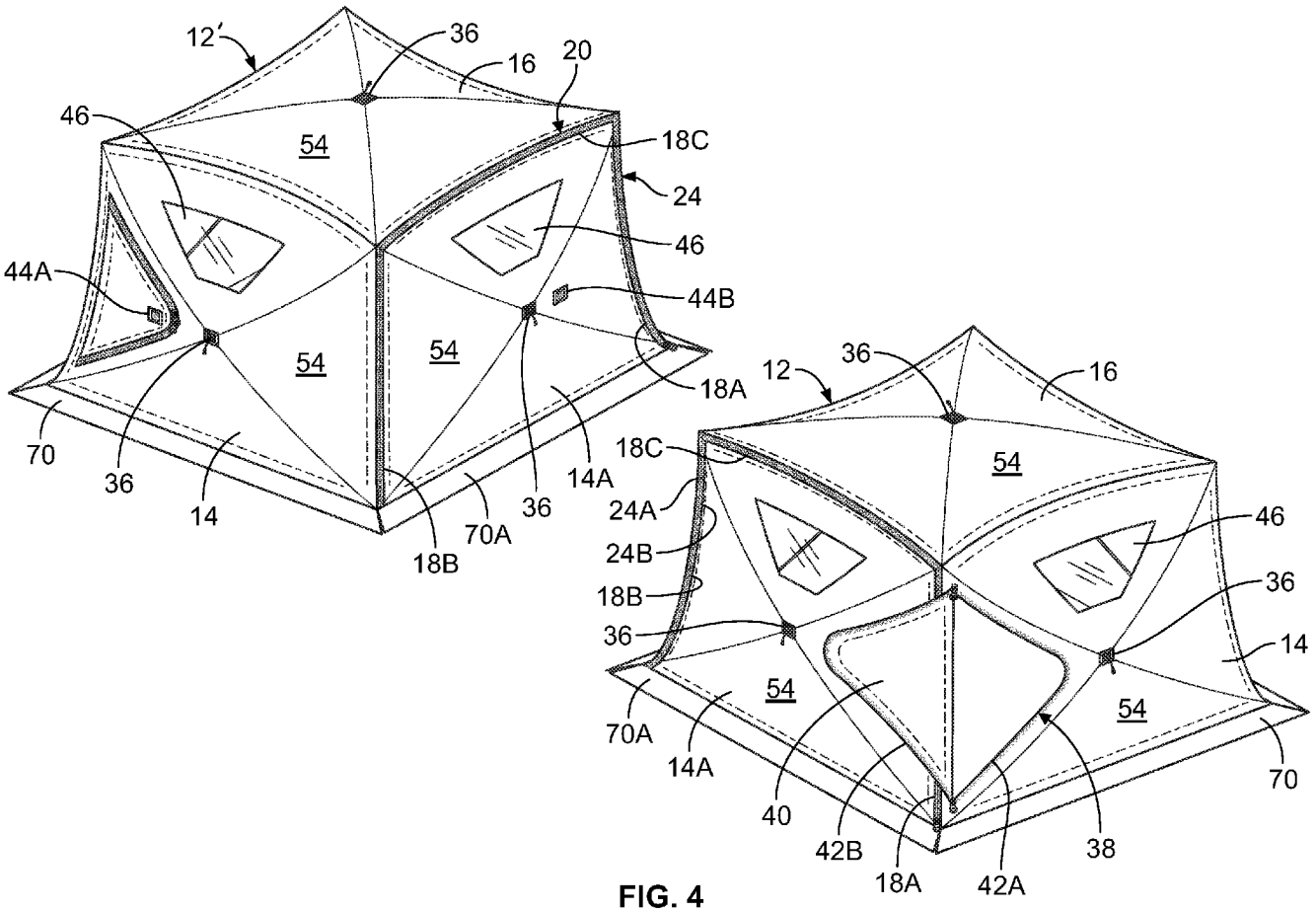
FIG. 4 is a perspective view of first and second enclosures of a further example convertible shelter system of the present disclosure, with each of the enclosures having a removable side wall.

Turning to a first example embodiment of a convertible shelter system shown in FIGS. 1-3, a convertible shelter system 10 is shown and generally comprises a portable enclosure 12 that includes a plurality of interconnected side walls 14, 14A defining an open floor space and being connected to a top wall 16, with at least one of the side walls 14A being configured to be removable. The removable side wall 14A has opposed first and second side edges 18A, 18B and a top edge 18C and defines an opening 20 in the enclosure 12. The opening 20 in the enclosure has a perimeter edge 22, having first and second side edges 22A, 22B and a top edge 22C, which further comprise a connecting member 24. The connecting member 24 is configured to selectively disconnect the removable side wall 14A from the perimeter edge 22 of the opening 20 along the first and second side edges 18A, 18B and the top edge 18C of the removable side wall 14A, or to hinge the removable side wall 14A from the enclosure by disconnecting the removable side wall 14A from the perimeter edge 22 of the opening 20 along the first side edge 18A and the top edge 18C of the removable side wall 14A. In this example, the perimeter edge 22 of the opening 20 is shown to be located at the corners from the removable side wall 14A to the adjacent side walls 14 and to the top wall 16. It will be appreciated that the perimeter edge 22 of the opening 20 could be spaced from the actual corners, but it is desirable to avoid having an intermediate wall, because it would create an obstruction and limit the freedom of movement through the opening 20.

It will be appreciated that the side walls 14 and removable side wall 14A may further include internal anchor straps 28 configured for use in holding a side wall 14 in place, or for holding the removable side wall 14A in a hinged, open position, as shown in FIG. 2. Such internal anchor straps 28 may include a tab of flexible material or fabric having an eyelet 28A through which an anchor 30 may pass downward and into the ground surface. The internal anchor straps 28 may be used adjacent the opening 20 to help anchor the enclosure to the ground surface and to keep the side walls 14 from moving further apart at the ground surface. In an example of use for ice fishing, the anchor 30 may be a threaded spike having a handle, for ease of turning by hand to secure the side walls 14 and/or to secure the removable side wall 14A in a selected hinged open position. This arrangement permits the removable side wall 14A to provide added utility by serving as a wind break, such as when it may be desirable if a user seeks to sit or fish outside of the enclosure, but to be at least partially sheltered from the wind. A hinging limiter 32, such as is shown for example in the form of a removable elongated strap, also may be provided to limit the angle to which the removable side wall 14A may swing to an open position. It will be appreciated that the hinging limiter 32 may be of various alternative constructions and may include a construction that is adjustable in length, such as may be provided by a buckle on the example strap.

In addition, the removable side wall 14A may be steadied and anchored in a hinged open position by an optional external anchor strap 34. Each of the side walls 14, 14A and top wall 16 may be equipped with an external connector 36, which are shown in FIGS. 1-3 at the center of each wall. As shown in FIG. 3, a first end of an external anchor strap 34 may be connected to an external connector 36 at the center of the removable side wall 14A and a second end of the external anchor strap 34 may be staked to the ground using a suitable anchor, such as the anchor 30 previously described, which may extend through and end of the external anchor strap 34.

As shown in FIGS. 1-3, at least one of the side walls 14 of the enclosure may include a doorway 38. In this example, the doorway 38 may be closed by a door 40 that is in the form of a flap of material or fabric of a side wall 14, or may include alternative materials that differ from the material of the side walls 14. In this example, the doorway 38 and door 40 are shown as having a connecting member 42 having complementary portions 42A and 42B of a zipper located at their edges to be able to provide a convenient and relatively weather proof closure. It will be appreciated that one or more zippers, or alternative mechanical connecting members, such as hook and loop fasteners, snaps or the like, also could be used to close a door in a side wall 14. Also, fasteners 44 may be used for holding open a door 40. The fasteners 44 may be of any suitable type, such as hook and loop, snaps or other alternatives. Thus, a first fastener portion 44A is shown on the exterior of a door 40, while a second fastener portion 44B is shown on an opposed exterior of a side wall 14, 14A, for removable connection when the door 40 is in a fully opened position.

FIGS. 1-3 also show at least one of the side walls 14, 14A may include a window 46. The window 46 may include a transparent panel and/or screen that is permanently connected to a side wall 14, 14A in a closed position, or may be configured to permit opening. It will be appreciated that additional windows of generally similar construction may be connected to the top wall 16, such as to form a skylight, or that windows may have an alternative construction, such as may be provided by a transparent or non-transparent flap that may be held in an open or closed position.

In this first example convertible shelter system, the connecting member 24 includes two portions, with a first portion 24A attached at the edge 22 of the opening 20 of the enclosure 12 and a second portion 24B attached along the side and top edges 18A, 18B and 18C of the removable the side wall 14A. While it may be of a different construction, the connecting member 24 is shown, for example, as including complementary portions of a detachable zipper assembly.

The example enclosure 12 further comprises a pop up structure that supports the side walls and top wall. In the example shown, each side wall 14, 14A and the top wall 16 have a hub 50 that is connected to a plurality of rods 52. The plurality of rods 52 are connected to a fabric panel 54 of the respective side wall or top wall, such as by fitting within a pocket in the corner of the respective panel. In this example, for each of the side walls 14, 14A and the top wall 16, the plurality of rods 52 include four rods 52 that are pivotally connected to the hub 50 and are movable to achieve an erected position that places the fabric panel 54 in tension, such as by pivoting to an over-center position. As seen in FIG. 3, an optional additional rod 58 may be used along the side of the opening 20 in the enclosure 12, if there is a desire for additional vertical support of a side wall 14 at the opening 20. The rods 52 and 54 may be somewhat flexible and may be constructed of suitable materials, such as fiberglass, plastic or metal. It also will be appreciated that alternative collapsible frame structures may be utilized.

A further example convertible shelter system 110 is shown in FIGS. 4-7, which includes as a first enclosure the enclosure 12 of the first example system. The convertible shelter system 110 of this example further comprises a similarly constructed second enclosure 12', which includes a plurality of interconnected side walls 14 defining an open floor space and being connected to a top wall 16, with at least one of the side walls 14A being removable. The removable side wall 14A has opposed first and second side edges 18A, 18B and a top edge 18C and defines an opening 20 in the second enclosure 12'. The opening 20 in the second enclosure 12' has a perimeter edge 22 that further comprises a connecting member 24 that is configured to selectively disconnect the removable side wall 14A from the perimeter edge 22 of the opening 20 along the first and second side edges 18A, 18B and the top edge 18C of the removable side wall 14A or to hinge the removable side wall 14A from the second enclosure 12' by disconnecting the removable side wall 14A from the perimeter edge 22 of the opening 20 along the first side edge 18A and the top edge 18C of the removable side wall 14A. As with the prior example, the connecting member 24 may include complementary portions 24A and 24B of a zipper or alternative connection assembly. For ease of explanation, the structure and features of the second enclosure 12' are, in all of the other respects, the same as those of the first enclosure 12, and therefore, they bear similar numerical references and the description need not be repeated.

The example convertible shelter system 110 of FIGS. 4-7 further includes a bridging panel 60 having first and second opposed side edges 60A, 60B with the first opposed side edge 60A configured to be connected to the first enclosure 12 at the opening 20 of the first enclosure 12 and the second opposed side edge 60B configured to be connected to the second enclosure 12' at the opening 20 of the second enclosure 12'. Indeed, when the at least one removable side wall 14A is removed from each of the first and second enclosures 12, 12' and the respective openings 20, 20 are located in an opposed and spaced apart position and the first enclosure 12 is connected by the bridging panel 60 to the second enclosure 12', the interconnected bridging panel 60 and side walls 14 of the first and second enclosures 12, 12' define an open and continuous floor space.

Figure 6:
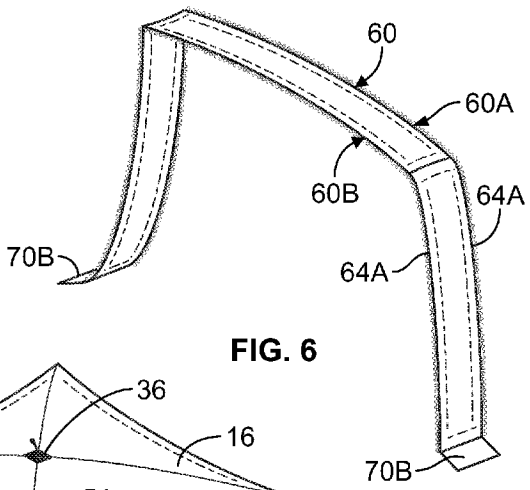
FIG. 6 is a perspective view of a bridging panel of the further example convertible shelter system of the present disclosure, which also includes the first and second enclosures of FIG. 5, and wherein the bridging panel has first and second opposed side edges configured to be connected to the first and second enclosures.
Figure 5:
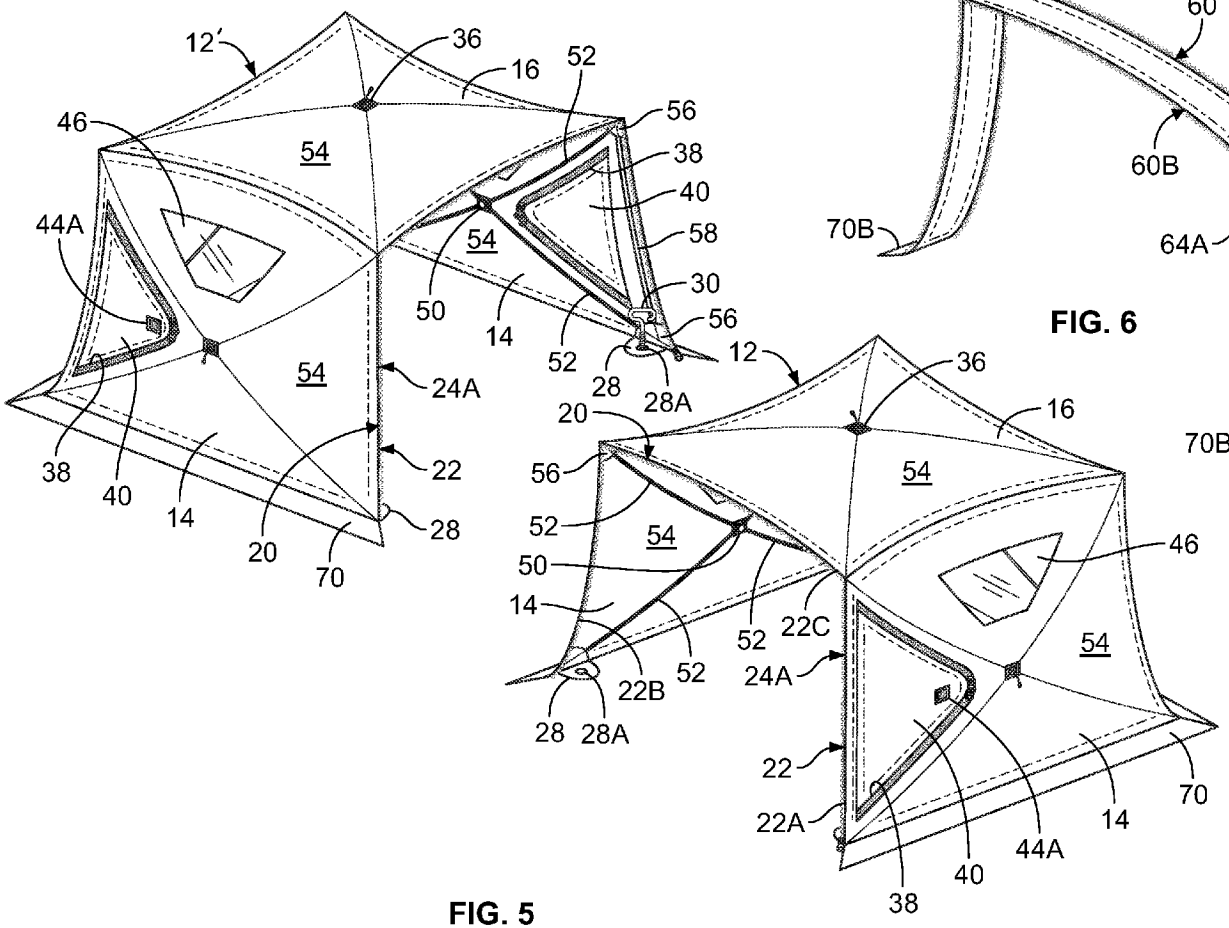
FIG. 5 is a perspective view of the first and second enclosures of FIG. 4, showing each of the enclosures having the removable side wall removed.
Figure 7:
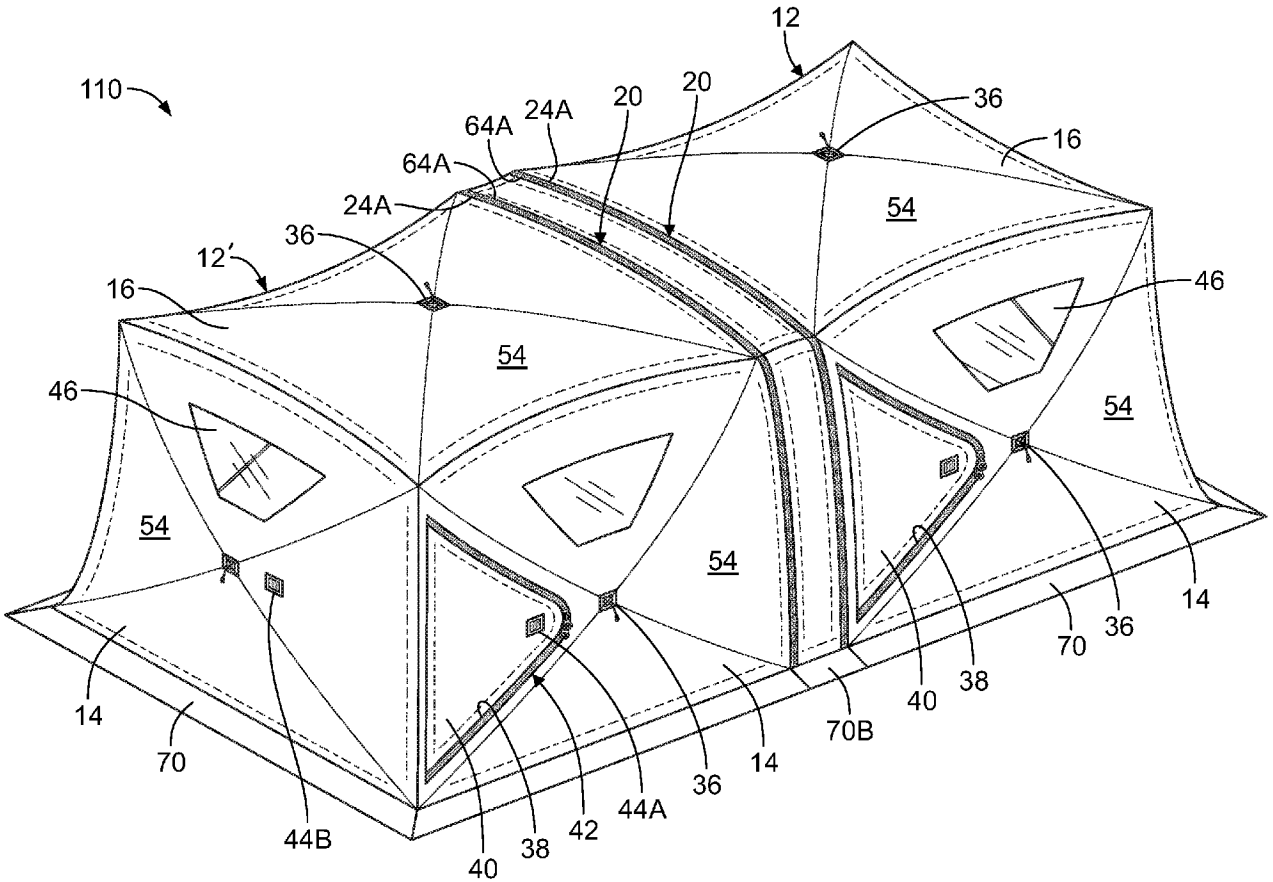
FIG. 7 is a perspective view of the further example convertible shelter system of the present disclosure having the first and second enclosures of FIG. 5 connected together by use of the bridging panel of FIG. 6.

As shown in FIGS. 6 and 7, at least one of the first and second opposed side edges 60A, 60B of the bridging panel 60 further comprises a connecting member 64 that is configured to be connected to the connecting member 24 located at the perimeter edge of the opening 20 of the first enclosure 12 or second enclosure 12'. It will be appreciated that alternative bridging panels and constructions may be incorporated into the system. For instance, the gap between the opposed and spaced apart openings 20, 20 of the first and second enclosures 12, 12' may be a filled by a bridging panel that is of a continuous construction or that may have multiple separate sections. Also, alternative connecting members may be used, including other fasteners, which may permit removable connection along one or both edges of a bridging panel.

In the example shown in FIGS. 4-7, the first opposed side edge 60A of the bridging panel 60 further comprises a connecting member 64A that is configured to be connected to a connecting member 24A located at the perimeter edge 22 of the opening 20 of the first enclosure 12 and the second opposed side edge 60B of the bridging panel 60 further comprises a connecting member 64A that similarly is configured to be connected to a connecting member 24A located at the perimeter edge 22 of the opening 20 of the second enclosure 12'. Each of the respective connecting members 64A and 24A of this example represent complementary portions of a zipper assembly, although it will be appreciated that other mechanical connecting members may be utilized, as previously noted.

The convertible shelter systems 10, 110 also are shown with a skirt 70 around the base of the exterior of each of the first and second enclosures 12, 12'. For each enclosure 12, 12', it will be appreciated that a portion 70A of the skirt 70 is connected to the removable side wall 14A, and therefore, is removed when a removable side wall 14A is removed from an enclosure. This ensures that the floor area, defined by the connected side walls 14 of the first and second enclosures 12, 12' and bridging panel 60, will not have an obstruction stretching between the respective enclosures 12, 12', and instead will have a continuous open floor. However, so as to ensure that the combined first and second enclosures 12, 12' and bridging panel 60 will have a full exterior skirt at the ground, the bridging panel 60 may include optional skirt portions 70B at its opposed ends. As shown in FIG. 7, the skirt portions 70B are located adjacent opposed side walls 14 of the first and second enclosures 12, 12', so as to complete the skirt when the first and second enclosures 12, 12' are connected by the bridging panel 60.

Figure 8:
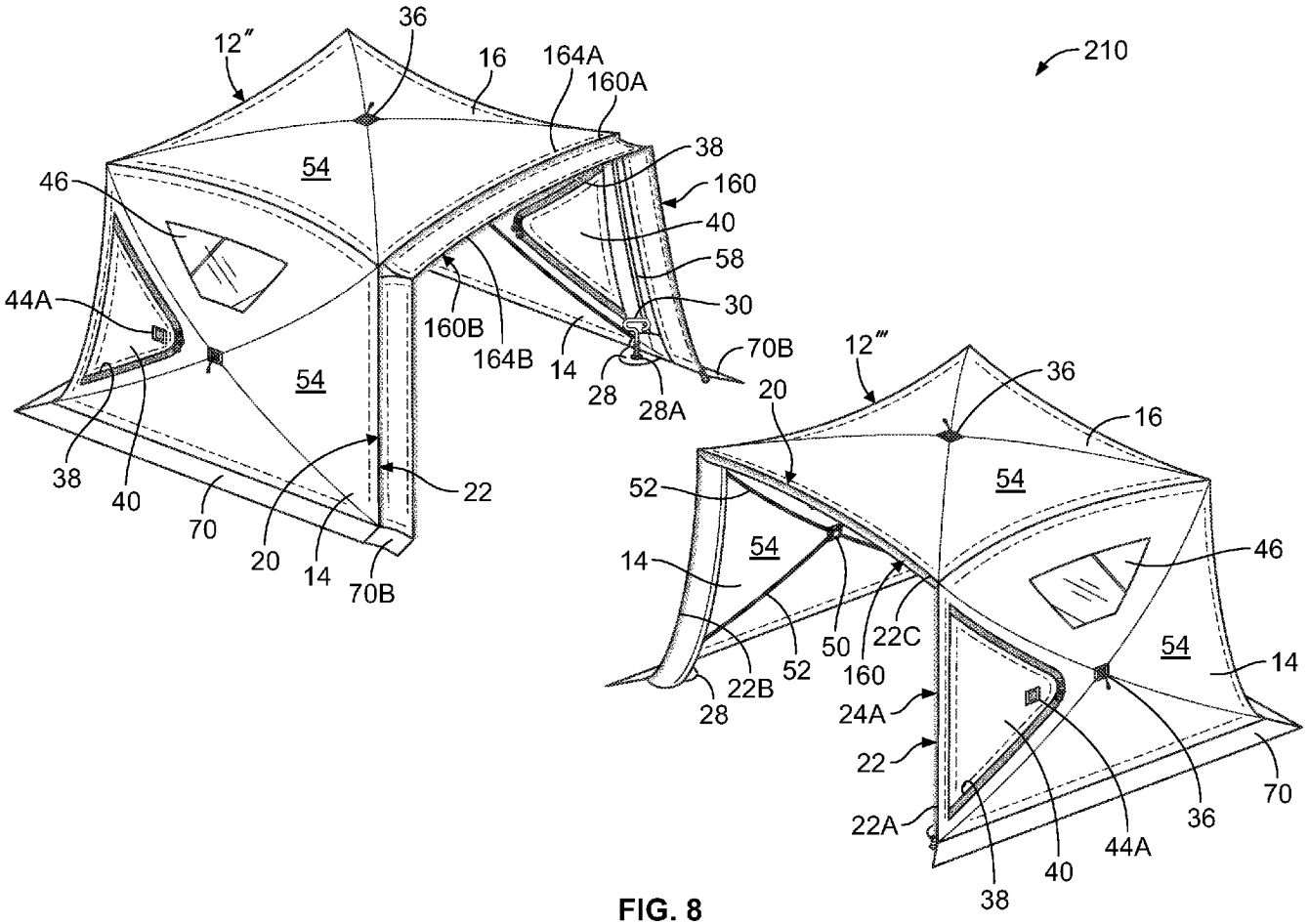
FIG. 8 is a perspective view of first and second enclosures of yet another example convertible shelter system of the present disclosure, with each of the enclosures having a removable side wall that has been removed and further including a bridging panel that is extendible from inward of the opening in the respective enclosure.
Figure 9:
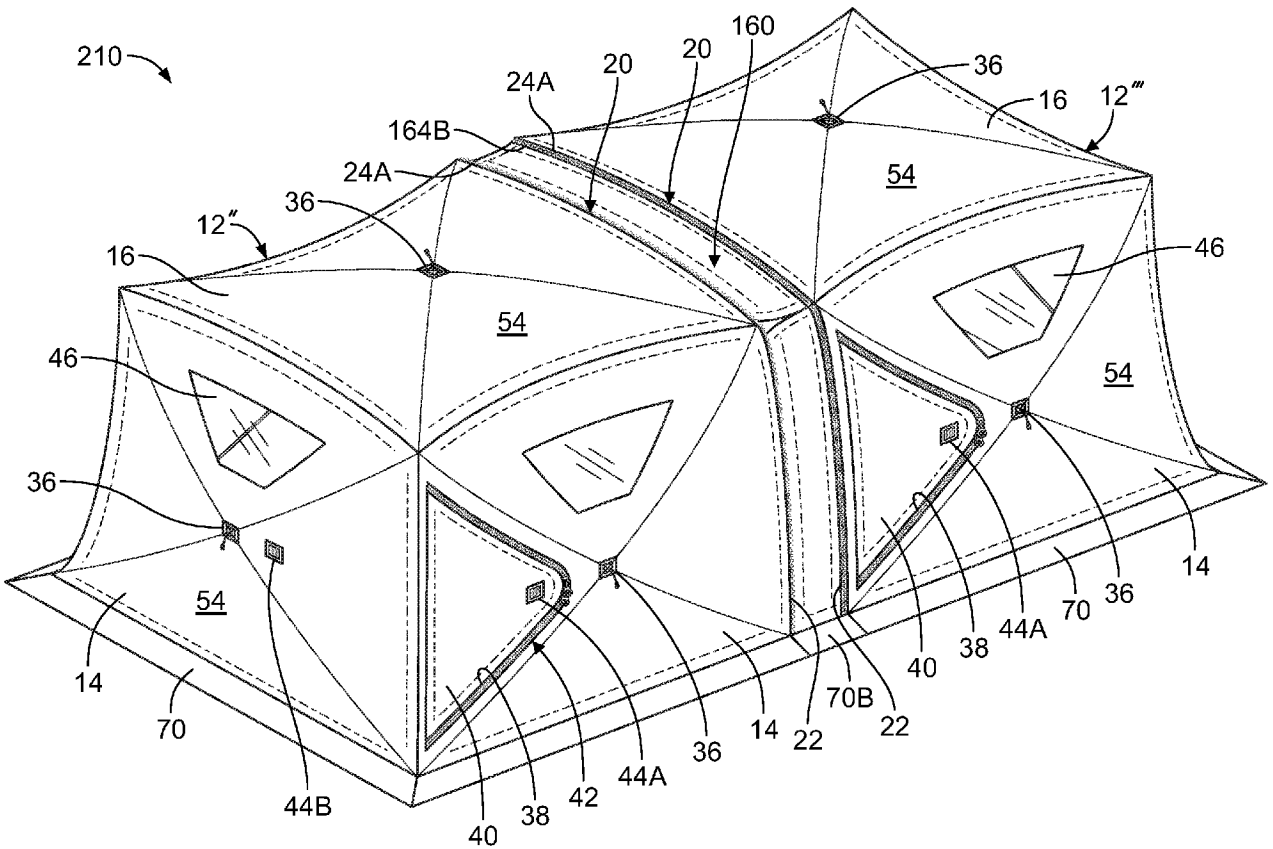
FIG. 9 is a perspective view of the additional example convertible shelter system of the present disclosure having the first and second enclosures of FIG. 8 connected together by use of the bridging panel that is extending from inward of the opening of one of the enclosures.

The present disclosure includes another example convertible shelter system 210, selective representative views of which are shown in FIGS. 8 and 9. This additional example is quite similar to the example shown in FIGS. 4-7, except with respect to having first and second enclosures 12", 12'", which differ from the earlier example first and second enclosures 12, 12' with respect to the inclusion of an alternative bridging panel 160 and its respective connection to first and second enclosures 12", 12'". Accordingly, similar reference numerals will be used for structures of this example that are similar to the structures shown for the earlier example first and second enclosures 12, 12'. However, different reference numerals will be used with respect to the alternative constructions relating to incorporation of the bridging panel 160.

In the example convertible shelter system 210, each of the first and second enclosures 12", 12'" is shown already having the respective removable side walls 14A of each enclosure removed, and as having a bridging panel 160 connected to each enclosure, with the bridging panel 160 of the first enclosure 12" deployed for use in connecting a first enclosure 12" to a second enclosure 12'". It will be appreciated that only one of the bridging panels 160 is needed to connect the enclosures 12", 12'", however, a bridging panel 160 could be included with each enclosure, for standardization of the enclosures. For instance, in FIG. 8, the first enclosure 12" is shown with a bridging panel 160 that is extending outward from just inward of the opening so as to be available for connection to a second enclosure 12'". Meanwhile, the bridging panel 160 of the second enclosure 12'" is shown with the bridging panel 160 rolled up and stowed just inside of the opening 20, such as by use of straps or other fasteners. Only one of the bridging panels 160 will be needed to connect the first and second enclosures 12", 12'".

Each bridging panel 160 includes first and second opposed side edges 160A and 160B. In this example, the first opposed side edge 160A has a connecting member 164A that is connected to the first enclosure 12" at the opening 20 of the first enclosure 12". The connection may be made permanently, such as by sewing, stitching, riveting, gluing or other suitable permanent connection of the first opposed side edge 160A along the interior of the side walls 14 and top wall 16. Alternatively, removable mechanical connecting assemblies may be used, such as hook and loop fasteners, snaps, or even a further zipper assembly, so as to permit the bridging panel 160 to be removable.

The second opposed side edge 160B of the bridging panel 160 of this example includes a connecting member 164B that is complementary to the connecting member 24A at the opening of the second enclosure 12'", which is shown as a portion of a zipper assembly along the edge 22 of the opening 20 of the second enclosure 12'". Thus, each of the first and second enclosures 12", 12'" of this example may be constructed to carry a built in or removable bridging panel 160 that remains with the enclosure 12", 12'" and is available for use with a similar enclosure at any time.

In light of the aforementioned description of the example convertible shelter systems, it will be appreciated that one may follow a method of assembling a convertible shelter system that is consistent with this disclosure. The method includes the steps of providing a first enclosure 12 (or 12"), a second enclosure 12' (or 12'") and a bridging panel 60 (or 160), wherein each of the first and second enclosures includes a plurality of interconnected side walls 14 defining an open floor space and being connected to a top wall 16, with the first and second enclosures each having at least one of the side walls 14A being removable, wherein the removable side wall 14A has opposed first and second side edges 18A, 18B and a top edge 18C and defines an opening 20 in the respective enclosure, wherein the opening 20 in the respective enclosure has a perimeter edge 22, and wherein the bridging panel 60 (or 160) has first and second opposed side edges 60A, 60B (or 160A, 160B) with the first opposed side edge configured to be connected to the first enclosure at the opening of the first enclosure and the second opposed side edge configured to be connected to the second enclosure at the opening of the second enclosure. The method further includes removing the removable side wall 14A of the first enclosure, removing the removable side wall 14A of the second enclosure, and positioning the first and second enclosures to have the opening 20 defined by the removed removable side wall 14A of the first enclosure 12 (or 12") opposed to and spaced from the opening 20 defined by the removed removable side wall 14A of the second enclosure 12' (or 12'"). The method also includes connecting the first enclosure at the opening 20 defined by the removed removable side wall 14A of the first enclosure 12 (or 12") to the first opposed side edge 60A (or 160A) of the bridging panel 60 (or 160) and connecting the second enclosure at the opening 20 defined by the removed removable side wall 14A of the second enclosure 12' (or 12'") to the second opposed side edge 60B (or 160B) of the bridging panel 60 (or 160), wherein the interconnected bridging panel 60 (or 160) and side walls 14 of the first and second enclosures define an open and continuous floor space.

It will be appreciated that the method of assembling a convertible shelter system in accordance with this disclosure also may include providing the perimeter edge 22 of the opening 20 of each of the first and second enclosures with a connecting member 24A. In addition, the method may further include providing at least one of the first and second opposed side edges 60A, 60B (or 160A, 160B) of the bridging panel with a connecting member 64A (or 164A) that is configured to be connected to the connecting member 24A located at the perimeter edge 22 of the opening 20 of the removed removable side wall 14A of the first or second enclosure.

Further, the method may include providing the first opposed side edge 60A of the bridging panel 60 with a connecting member 64A that is configured to be connected to a connecting member 24A located at the perimeter edge 22 of the opening 20 of the removed removable side wall 14A of the first enclosure 12 and the second opposed side edge 60B of the bridging panel 60 with a connecting member 64A that is configured to be connected to a connecting member 24A located at the perimeter edge 22 of the opening 20 of the removed removable side wall 14A of the second enclosure 12'. It follows that the method also may further include connecting the connecting member 64A on the first opposed side edge 60A of the bridging panel 60 to the connecting member 24A located at the perimeter edge 22 of the opening 20 of the removed removable side wall 14A of the first enclosure 12, and connecting the connecting member 64A on second opposed side edge 60B of the bridging panel 60 to the connecting member 24A located at the perimeter edge 22 of the opening 20 of the removed removable side wall 14A of the second enclosure 12'.

The method of assembling a convertible shelter system in accordance with this disclosure also may include having each of the first and second enclosures 12 (or 12"), 12' (or 12'") include a pop up structure having each of the side walls 14, 14A and the top wall 16 further include a hub 50 that is connected to a plurality of rods 52, with the plurality of rods 52 being connected to a fabric panel 54. The method may then include, for each of the side walls 14, 14A and the top wall 16 of each of the first and second enclosures 12 (or 12"), 12' (or 12'"), the plurality of rods 52 are pivotally connected to the hub 50 and are movable from a collapsed position to an erected position that places the fabric panel 54 in tension, with the method including the step of pivoting the rods 52 relative to the hubs 50 of the respective top walls 16 and side walls 14, 14A to erect the pop up structure of the first and second enclosures 12 (or 12"), 12' (or 12'").

From the above disclosure, it will be apparent that convertible shelter systems constructed in accordance with this disclosure may include a number of structural aspects that provide numerous advantages over conventional constructions. The example convertible shelter systems shown herein may exhibit one or more of the above-referenced potential advantages, depending upon the specific design chosen.

It will be appreciated that a convertible shelter system constructed in accordance with the present disclosure may be provided in various configurations. Any variety of suitable materials of construction, configurations, shapes and sizes for the components and methods of connecting the components may be utilized to meet the particular needs and requirements of an end user. It will be apparent to those skilled in the art that various modifications can be made in the design and construction of such convertible shelter systems, as well as in the method of assembling a convertible shelter system, without departing from the scope or spirit of the claimed subject matter, and that the claims are not limited to the preferred embodiments and methods illustrated herein. It also will be appreciated that the example embodiments may be shown in simplified form, so as to focus on the key components and to avoid including structures that are not necessary to the disclosure and that would over complicate the drawings.

The invention claimed is:

1. A convertible shelter system, comprising:

a first enclosure that includes a plurality of interconnected side walls defining an open floor space and being connected to a top wall, and further comprising a pop up structure wherein each side wall and the top wall have a hub that is connected to a plurality of rods, with the plurality of rods being connected to a fabric panel;

at least one of the side walls being removable, wherein the removable side wall has a bottom edge that engages a ground surface, and further has opposed first and second side edges and a top edge and defines an opening in the first enclosure;

wherein the opening in the first enclosure has a perimeter edge that further comprises a connecting member that is configured to selectively disconnect the removable side wall from the perimeter edge of the opening along the first and second side edges and the top edge of the removable side wall or to hinge the removable side wall from the first enclosure by disconnecting the removable side wall from the perimeter edge of the opening along the first side edge and the top edge of the removable side wall;

a second enclosure, with the second enclosure further comprising a plurality of interconnected side walls defining an open floor space and being connected to a top wall, and further comprising a pop up structure wherein each side wall and the top wall have a hub that is connected to a plurality of rods, with the plurality of rods being connected to a fabric panel;

at least one of the side walls being removable, wherein the removable side wall has a bottom edge that engages a ground surface, and further has opposed first and second side edges and a top edge and defines an opening in the second enclosure;

wherein the opening in the second enclosure has a perimeter edge that further comprises a connecting member that is configured to selectively disconnect the removable side wall from the perimeter edge of the opening along the first and second side edges and the top edge of the removable side wall or to hinge the removable side wall from the second enclosure by disconnecting the removable side wall from the perimeter edge of the opening along the first side edge and the top edge of the removable side wall; and a bridging panel having first and second opposed side edges with the first opposed side edge configured to be connected to the first enclosure at the opening of the first enclosure and the second opposed side edge configured to be connected to the second enclosure at the opening of the second enclosure; and wherein when the at least one removable side wall, including the hub connected to the plurality of rods and the bottom edge that engages the ground surface, is removed from each of the first and second enclosures and the respective openings are located in an opposed and spaced apart position and the first enclosure is connected by the bridging panel to the second enclosure, the interconnected bridging panel and side walls of the first and second enclosures define a collective open and continuous floor space.

2. The convertible shelter system in accordance with claim 1, wherein the removable side wall of the first enclosure further comprises anchor straps configured for use in holding the removable side wall in a hinged, open position.

3. The convertible shelter system in accordance with claim 1, wherein at least one of the side walls of the first enclosure further comprises a doorway.

4. The convertible shelter system in accordance with claim 1, wherein at least one of the side walls of the first enclosure further comprises a window.

5. The convertible shelter system in accordance with claim 1, wherein the first enclosure further comprises a strap that limits the extent to which the removable side wall is able to be hinged open from the opening in the first enclosure.

6. The convertible shelter system in accordance with claim 1, wherein the connecting member of the first enclosure further comprises a portion of an attachable and detachable assembly.

7. The convertible shelter system in accordance with claim 1, wherein the connecting member of the first enclosure further comprises a portion of a zipper assembly.

8. The convertible shelter system in accordance with claim 1, wherein for each of the side walls and the top wall, the plurality of rods are pivotally connected to the hub and are movable to achieve an erected position that places the fabric panel in tension.

9. The convertible shelter system in accordance with claim 1, wherein at least one of the first and second opposed side edges of the bridging panel further comprises a connecting member that is configured to be connected to the connecting member located at the perimeter edge of the opening of the first or second enclosure.

10. The convertible shelter system in accordance with claim 1, wherein the first opposed side edge of the bridging panel further comprises a connecting member that is configured to be connected to a connecting member located at the perimeter edge of the opening of the first enclosure and the second opposed side edge of the bridging panel further comprises a connecting member that is configured to be connected to a connecting member located at the perimeter edge of the opening of the second enclosure.

11. The convertible shelter system in accordance with claim 1, wherein the bridging panel has opposed ends that are located adjacent opposed side walls of the first and second enclosures when the first and second enclosures are connected by the bridging panel.

* * * * *